United States Patent [19]

Morgan

[11] 4,106,291

[45] Aug. 15, 1978

[54] CORE MACHINE HAVING HYDROSTATIC DRIVE

[75] Inventor: George H. Morgan, South Bend, Ind.

[73] Assignee: Lambert Brake Corporation, St. Joseph, Mich.

[21] Appl. No.: 783,325

[22] Filed: Mar. 31, 1977

[51] Int. Cl.[2] ..... F15B 15/18

[52] U.S. Cl. ..... 60/369; 60/403; 91/275; 91/339

[58] Field of Search ..... 60/369, 403, 493, 905; 91/275, 339, 340, 354

[56] References Cited

U.S. PATENT DOCUMENTS

| | | | |
|---|---|---|---|
| 2,984,985 | 5/1961 | MacMillin | 60/471 X |
| 3,434,283 | 3/1969 | Piret | 91/275 X |
| 3,489,063 | 1/1970 | Piret | 91/275 |
| 3,969,897 | 7/1976 | Humphreys et al. | 60/905 X |

*Primary Examiner*—Edgar W. Geoghegan
*Attorney, Agent, or Firm*—Olson, Trexler, Wolters, Bushnell & Fosse, Ltd.

[57] ABSTRACT

A hydrostatic drive is disclosed in combination with a machine tool such as a sand core molding machine. A machine of this type comprises a fixed carriage and a core molding die mounted for rotation on the carriage. The drive includes a reversible fluid power motor having an output shaft. The motor output shaft is connected to a fail safe fluid power brake, and the brake shaft is, in turn, connected to a power transmission unit. When fluid power is applied to the brake and the motor, brake override means operate to release the brake to permit the motor shaft, brake shaft and tranmission to be turned by the motor and thereby operate the movable die.

10 Claims, 2 Drawing Figures

A
10
15
14
12
15
68
+ −
16
13
14
66
40
14
65
39
11
11
21
38
20
58
57
67
22
40
41
55
67
52
47
48
60
53
69
42
56
70
49
50
45

35
11
22
28
29
23
24
30
20
21
25
27
38
25
33
30
35
11

CORE MACHINE HAVING HYDROSTATIC DRIVE

BACKGROUND OF THE INVENTION

This invention relates generally to drives for machine tools having large movable assemblies mounted on fixed carriages, and more particularly concerns drives which can rapidly start and rapidly and precisely halt such assembly motion.

In modern manufacturing shops, many machine tools include large fixed carriages upon which move large, heavy, high-inertia assemblies. For example, core and mold machines are often found in metal foundries for making sand cores and molds used in casting operations for metal molding. These sand shell core and mold manufacturing machines include a fixed carriage, and a large, heavy, heated die or core box mounted for rotation or oscillation upon the carriage. During machine operation, a mixture of sand and resin binder is introduced, as by blowing into the die. To spread the sand and resin evenly about the interior surfaces of the die, and to provide a high quality mold product, the die is rotated or oscillated as the sand and resin are being injected.

When the casting mold or core has been fully formed within the machine, die movement is stopped, a die door is opened, and the finished sand core or mold is removed. When die oscillation stops, it is essential that the die come to rest at a precise location so that the door can be opened and closed without interference with other machine parts.

The oscillating core box or die and movable assembly which carries the die on a machine carriage can be quite heavy—they can weigh on the order of 1000 to 2000 pounds. Heretofore, this movable assembly has been oscillated on the machine carriage by a drive including an electric motor operating through a worm gear speed reducer. A small brake at the motor blind end assists in halting die movement and in retaining the die in the desired position for die door opening.

However, practical experience with the machine and its drive has shown that after a period of service, the drive parts wear sufficiently so that precise die positioning for door opening becomes an increasing problem. Adjustment and readjustment of this drive and die-locating mechanism may be required two or three times during a working day or shift. The resulting machine down time can thus be a matter of concern and frustration to the machine operator and a matter of considerable expense to the machine owner.

It is therefore the general object of the present invention to provide a drive for heavy machine tools which overcomes the foregoing difficulties.

More specifically, it is an object of the present invention to provide a machine tool drive having good starting and stopping torque characteristics for starting machine operation quickly, and for stopping machine motion quickly and precisely.

A related object is to provide such a machine drive which is reliable and rugged in operation, and which provides a long service life with minimal adjustment and repairs. A further object is to provide such a drive which is not greatly subject to drive part wear.

Another object is to provide such a machine drive which is compact in its overall shape and size to permit the drive to be located at a convenient position in and upon the machine.

Still another object is to provide such a machine drive which can be offered at a commercially attractive price. An ancillary object is to provide such a drive which requires no expensive adapters or interconnectors between a motor and a brake unit.

Other objects and advantages of the invention will become apparent upon reading the following detailed description and upon reference to the drawings. Throughout the drawings, like reference numerals refer to like parts.

DETAILED DESCRIPTION OF THE DRAWINGS

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Figure 1:
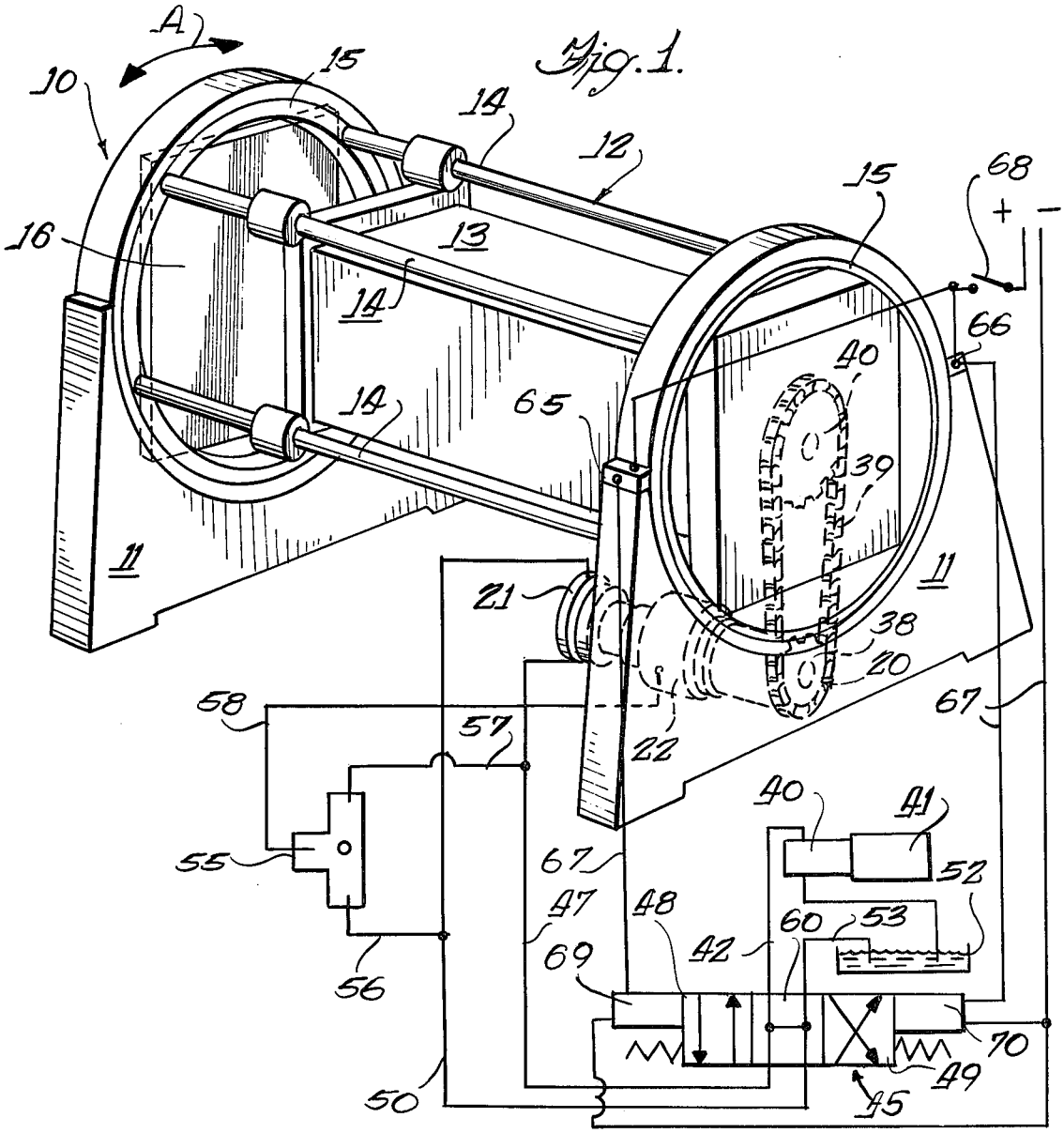
FIG. 1 is a perspective view of a typical sand core and mold manufacturing machine tool and showing a die assembly drive and, in diagrammatic form, a fluid power circuit for energizing the die drive.

Turning first to FIG. 1, there is shown a typical large, heavy machine tool, here represented as a sand core molding machine 10. A fixed carriage or frame 11 mounts a movable assembly 12 which here includes a die 13 carried on tie rods 14 between bearings 15. As suggested above, a mixture of sand and resin can be blown into the die 13 to form a sand core or mold (not shown) for use in subsequent metal casting operation. During this sand core manufacturing operation, the movable assembly 12 is rotated or oscillated on the fixed frame 11 as indicated by arrow A. Such machines are offered by the Shalco Systems Division of the Acme-Cleveland Company, 12819 Coit Road, Cleveland, Ohio.

Figure 2:
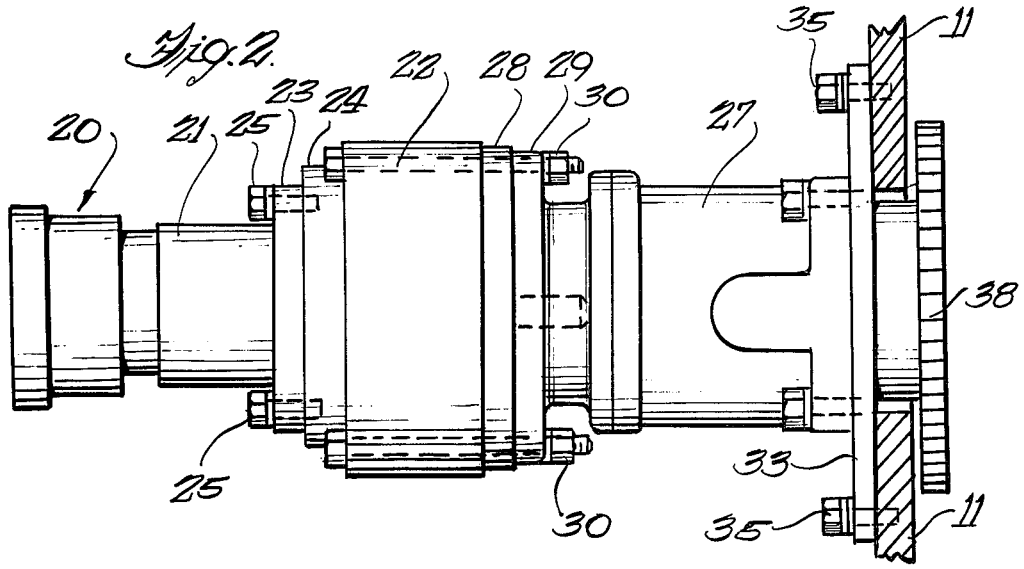
FIG. 2 is a fragmentary elevational view in partial section showing in further detail the machine tool drive mechanism.

The machine drive 20 shown in FIGS. 1 and 2 powers this oscillatory turning motion. To provide the high starting torque desired in accordance with one aspect of the invention, the drive 20 includes a reversible fluid power motor 21. Long service life and reliable, rugged operation can be obtained from a reversible vane type hydraulic motor. The motor is provided with an output shaft and vaned internal mechanism (not shown) for rotating that shaft in either of two directions in response to the application of pressurized fluid such as hydraulic fluid delivered through the circuit described below. One such motor which can be used for the purposes described here in a motor designated as Model No. DBS-9 "S" type Geroter 4.3 CID. This motor is offered by the Char-Lynn Plant, Fluid Power Division, Eaton Corporation, 15151 Highway 5, Eden Prairie, Mn.

The hydraulic motor 21 is here directly mated with a fail-safe hydraulic brake 22. It is a feature of the invention that the hydraulic motor is provided with an outward shaft which can be mated directly with the input portion of a brake shaft in the brake. Here, the brake is an Ausco No. 28653 fail-safe brake available from Auto Specialties Manufacturing Company, 643 Graves Street, St. Joseph, Mi. As illustrated these two units 21 and 22 are secured together by mating flanges 23 and 24 and through bolts 25.

As is known, this hydraulic brake 22 is of a type which is provided with a number of rotors carried upon the brake shaft, and a number of interleaved stators are movably carried within the brake housing for retarding rotation of the rotors and brake shaft. Normally, these rotors and stators are urged or biased into braking interengagement by normally operative devices such as spring structure or the like. As noted, the hydraulic brake 22 is of a fail-safe design, and to overcome this braking action, the brake is provided with hydraulic pistons and related mechanisms located to overcome the biasing effect of the springs, thereby freeing the stators from interengagement with the rotors and permitting relatively free brake shaft and rotor rotational movement when hydraulic pressure is applied.

In accordance with another aspect of the invention, the brake shaft can be easily and directly connected to a drive shaft in a transmission. Here, a transmission 27 is bolted to the hydraulic brake unit 22 by mating flanges 28 and 29 and through bolts 30. The illustrated transmission is designated as a Self-Contained Gear Head Reducer No. G31-S2-J1-2 and is available from the Borg-Warner Corporation, 200 South Michigan Avenue, Chicago, Ill.

The entire drive unit is secured to the machine 10 by a bolt plate 33 which directly interconnects the transmission 27 and the fixed carriage 11 by appropriate bolts 35. To transmit the power developed by the drive unit 20, a sprocket wheel 38 can be affixed to an output shaft (not shown) on the transmission 27. As shown in FIG. 1, the sprocket 38 here drives an endless drive chain 39 to rotate a drive sprocket 40 secured to the die 13.

To power this drive train 20, the fluid power circuit shown in FIG. 1 is provided. Here a pump 40, driven by an electric motor 41 or other convenient means, pressurizes hydraulic fluid in an output line 42 leading to a three-position electrically operated control valve 45. When the fluid is delivered from the output line 42 to a first line 47, as through a fluid path arrangement within the valve as indicated by the fluid connection path symbol 48, the reversible hydraulic motor 21 is driven in a first direction. Fluid is exhausted from the motor by a second line 50. When, however, the fluid flow path through the valve is reversed as indicated by the symbol 49, fluid is delivered to the hydraulic drive by the second line 50, and is exhausted from the drive through the first line 47. Under either condition, low pressure, exhausted fluid is returned to the reservoir tank 52 through a tank delivery line 53.

In carrying out the invention, fluid is delivered to the hydraulic failsafe brake 22 whenever the first line 47 or the second line 50 is pressurized to deliver fluid to the hydraulic motor 21. To this end, a shuttle type check valve 55 is connected by branch lines 56 and 57 to the main lines 47 and 50, respectively. The shuttle check valve 55 is provided with internal mechanism (not shown) which pressurizes an output brake branch line 58—and consequently the brake 22 itself—whenever fluid is caused to flow toward the motor 21 through either of the lines 47 or 50.

To suddenly halt pressurized fluid delivery to the hydraulic motor 21 and consequently halt motor rotation, and to apply the fail-safe brake 22 with equal suddenness, the valve 45 is provided with a third or mediate position 60 which, as illustrated, simply permits fluid provided by the pump 40 to be returned to the tank 52 by the delivery line 53 without passing through or pressurizing the remaining portions of the hydraulic system. Fluid within the lines 47 and 50 and the pressurized brake branch line 58 is also depressurized, and the fluid returns to the tank 52 in sufficient quantities to reduce the pressure in those lines 47, 50 and 58 to pressure amounts below which the motor will operate and below which the brake will be maintained in its free-runing configuration. Under these circumstances, the motor stops its operation, the transmission consequently stops movement of the die 13, and the brake 22 simultaneously applies a positive affixing action to the machine drive 20 and the die 13 itself.

It is another feature of the invention that the system can provide oscillatory motion on a relatively endless basis. To this end, limit switch sensors 65 and 66 are connected, as by appropriate electric wiring 67 and a master switch 68 to valve operating mechanisms 69 and 70 of known design. These sensors 65 and 66 are positioned upon the fixed carriage 11 so as to be operatively interposed between the fixed carriage 11 and the movable assembly 12 at appropriate end limits of desired paths of movable assembly oscillation or travel. When the movable assembly 12 rotates to the end of its desired path of travel, the limit switch 65 or 66 is operated so as to alter the signal sent along the lines 67 to the valve operators 69 and 70. These valve operators 69 and 70 then alter the position of the valve spool within the valve body of the valve 45 and correspondingly alter the operation of the fluid circuit. The motor 21 is consequently rotated in an alternate direction. In this way, the movable assembly 12 can be caused to oscillate continuously and provide the desired sand and resin blowing and depositing effect within the die 13. Alternatively, the sensors 65 and 66 can be disconnected from the circuit by appropriate wiring to permit the die 13 to simply continuously rotate in a given single direction without oscillation. Whether the motion is oscillatory or rotational, appropriate actuation of the valve 45 will immediately halt the machine motion and affix the movable assembly 12 upon the fixed carriage 11 to permit the doors 16 to be opened and the completed casting cores to be removed.

The invention is claimed as follows:

1. A hydrostatically powered machine drive in combination with a machine having a fixed carriage and an assembly movable on the carriage, the drive comprising a reversible fluid power motor having an output shaft and fluid power means for rotating the output shaft in either of two directions; a failsafe fluid power brake having a brake shaft directly coupled with the motor output shaft, brake means for selectively engaging the brake shaft and retarding brake shaft rotation, means normally urging the brake means into engagement with the brake shaft for normally retarding brake shaft rotation and selectively energizable fluid power brake override means for overriding the brake-urging means so as to disengage the brake means and permit free brake shaft rotation when the fluid power override means is energized; transmission means having a drive shaft directly coupled with the brake shaft and means operatively coupled with the movable assembly to transmit motion from the motor output shaft and brake shaft to the movable assembly; and fluid power circuit means for powering said machine drive and including a source of pressurized fluid and conduit means for selectively leading the pressurized fluid from the source to the brake override means to permit free brake shaft rotation and for leading pressurized fluid from the source to the fluid power motor to drive the fluid power motor output shaft, the brake shaft and the transmission means drive shaft so as to move the machine movable assembly upon the fixed carriage, withdrawal of fluid power pressure to the fluid power motor and brake override means operating to terminate motor driving action on the motor output shaft and to allow engagement of brake means with the brake shaft means so as to halt motion of the movable assembly and to precisely fix the movable assembly in a stationary position on the machine carriage.

2. The combination according to claim 1 wherein said machine includes a movable die assembly rotatable on the fixed carriage, and wherein the transmission means includes geared means coupled to the transmission drive shaft means and chain drive means coupled to the geared means and to the movable die assembly to rotate the die assembly on the machine fixed carriage.

3. The combination according to claim 1 including fluid power valve means operatively connected in the fluid power circuit means, and capable of being set in one of two alternate positions of operation, and wherein said conduit means includes alternate conduits leading from the fluid power valve means to said reversible fluid power motor to permit the motor to be selectively and alternatively operated in either of its two directions of rotation when the appropriate valve position is selected.

4. The combination according to claim 3 wherein said movable machine assembly travels over said fixed carriage along a limited path, at least one limit switch sensor means functionally interposed between said fixed carriage and said machine movable assembly at an end limit of the path of movable assembly travel and being adapted to alter a signal when the movable assembly arrives at the end of its path of travel, and signal transmitter means connected between the limit switch sensor means and said fluid power valve means to alter the position of the power valve means and thereby cause the movable assembly to be driven away from the end limit of its path of travel in an alternate direction upon signal alteration.

5. The combination according to claim 4 including a second limit switch sensor means functionally interposed between the machine fixed carriage and the movable assembly at a second end limit of the path of movable assembly travel, and a second signal transmitter means connected between the second limit switch sensor means and the fluid power valve means to provide cyclic motion of the movable assembly on the machine fixed carriage.

6. A hydrostatically powered machine drive comprising, in combination, a reversible fluid power motor having an output shaft and fluid power means for rotating the output shaft in either of two directions, a failsafe fluid power brake having a brake shaft directly coupled to the motor output shaft and operatively connected with apparatus to be driven, brake means for selectively and normally engaging the brake shaft to retard brake shaft rotation, and fluid power brake override means for selectively disengaging the brake means from the brake shaft to permit free brake shaft and motor output shaft rotation; said reversible fluid power motor and said failsafe brake being responsive to application of pressurized fluid thereto along selectively alternate paths to drive the motor output shaft and brake shaft in correspondingly alternate directions of rotation, and responsive to cessation of said application of pressurized fluid to cause cessation of motor output shaft rotation and positive fixation of the brake shaft means against further rotation.

7. A hydrostatic powdered machine drive according to claim 6 further including transmission means connected to said brake shaft to deliver motion from said motor output shaft and the brake shaft to a machine tool assembly movably mounted on a fixed carriage.

8. A hydrostatic drive according to claim 6 further including fluid power circuit means including a source of pressurized fluid, conduit means connecting said source to said fluid power motor and to said failsafe brake and alterable valve means in said conduit means for controlling said application of pressurized fluid along said alternate paths and said cessation of application of pressurized fluid and switch means for altering said valve means to cause said fluid power motor to be driven first in one direction and then in an opposite direction.

9. A hydrostatic drive in combination with a core and mold making machine having a fixed carriage mounting a die door, carriage bearing means and a heavy die carried on the bearing means for rotational motion relative to the fixed carriage, the drive comprising a reversible fluid power motor having an output shaft and fluid power means for rotating the output shaft in either of two directions; a failsafe fluid power brake having a brake shaft coupled directly to the motor output shaft, brake means for selectively engaging the brake shaft and retarding brake shaft rotation, means normally urging the brake means into engagement with the brake shaft for normally retarding brake shaft rotation and selectively energizable fluid power brake override means for overriding the brake-urging means to disengage the brake means and permit free brake shaft rotation when the fluid power override means is energized; transmission means including a drive shaft coupled directly to the brake shaft and means operatively coupled with the machine die to transmit rotational motion from the motor output shaft and brake shaft to the machine die; and fluid power circuit means including a source of pressurized fluid and conduit means for selectively leading the pressurized fluid from the source to the brake override means to permit free brake shaft rotation and for leading pressurized fluid from the source to the fluid power motor to drive the fluid power motor output shaft and brake shaft and rotate the die upon the fixed carriage, withdrawal of fluid power pressure to the motor and brake means operating to terminate motor driving action on the motor output shaft and to apply braking action to the brake shaft so as to halt rotation of the die and to precisely fix the die in a stationary position on the machine fixed carriage conducive to die door opening.

10. The combination according to claim 9 wherein said machine die rotates on said fixed carriage over a limited path, the combination further including at least one limit switch sensor means functionally interposed between said machine fixed carriage and said machine die at an end limit of the path of die rotational travel and being adapted to alter a signal when the die arrives at the end of its path of rotational travel, and signal transmitter means connected between the limit switch sensor means and an element in said fluid power circuit means to cause the die to be driven away from the end limit of its path of travel in an alternate direction upon signal alteration.

* * * * *